US006725817B2

(12) United States Patent
Methley et al.

(10) Patent No.: US 6,725,817 B2
(45) Date of Patent: Apr. 27, 2004

(54) VARIABLE PHASE DRIVE MECHANISM

(75) Inventors: Ian Methley, Witney (GB); Timothy Mark Lancefield, Shipston on Stour (GB)

(73) Assignee: Mechadyne PLC, Oxon (GB)

( * ) Notice: Subject to any disclaimer, the term of this patent is extended or adjusted under 35 U.S.C. 154(b) by 141 days.

(21) Appl. No.: 10/004,323

(22) Filed: Nov. 14, 2001

(65) Prior Publication Data

US 2002/0059910 A1 May 23, 2002

(30) Foreign Application Priority Data

Nov. 18, 2000 (GB) ..... 0028175

(51) Int. Cl.[7] ..... F01L 1/34

(52) U.S. Cl. ..... 123/90.17; 123/90.15; 123/90.31; 74/568 R

(58) Field of Search ..... 123/90.15, 90.16, 123/90.17, 90.27, 90.31; 74/568 R, 92

(56) References Cited

U.S. PATENT DOCUMENTS 4,332,222 A * 6/1982 Papez ..... 123/90.17
5,233,948 A * 8/1993 Boggs et al. ..... 123/64
5,235,939 A * 8/1993 Levin et al. ..... 123/90.15
6,076,492 A * 6/2000 Takahashi ..... 123/90.17
6,244,230 B1 * 6/2001 Mikame ..... 123/90.17

* cited by examiner

*Primary Examiner*—Thomas Denion
*Assistant Examiner*—Jaime Corrigan
(74) *Attorney, Agent, or Firm*—Smith-Hill and Bedell

(57) ABSTRACT

A variable phase drive mechanism is described for providing drive from an engine crankshaft to two sets of cams. The drive mechanism comprises a drive member 32 connectable for rotation with the engine crankshaft and two driven members 38 and 40, each connectable for rotation with a respective one of the two sets of cams. Each of the driven members 38, 40 is connected by a vane-type hydraulic coupling for rotation with the drive member 32. The hydraulic coupling between the drive and driven members is such as to enable the angular position of each of the driven members 38 and 40 to be varied relative to the drive member 32 independently of the other driven member.

8 Claims, 5 Drawing Sheets

Figure 1:
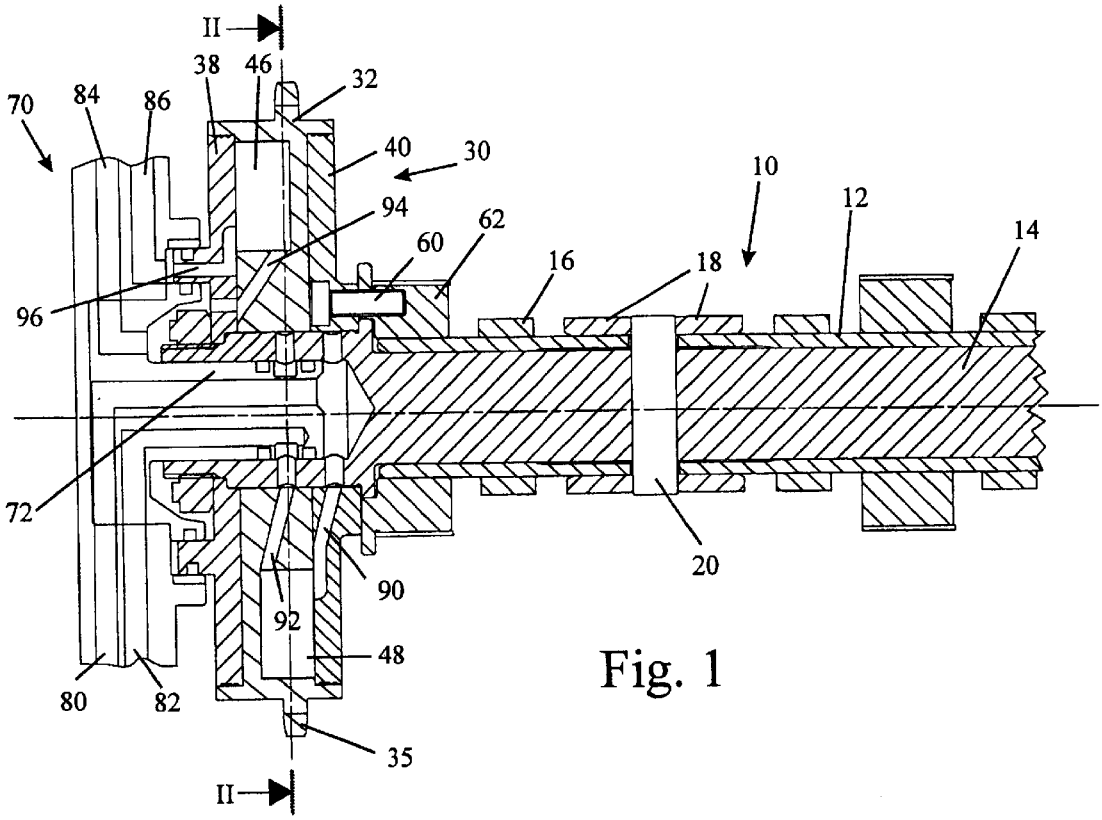

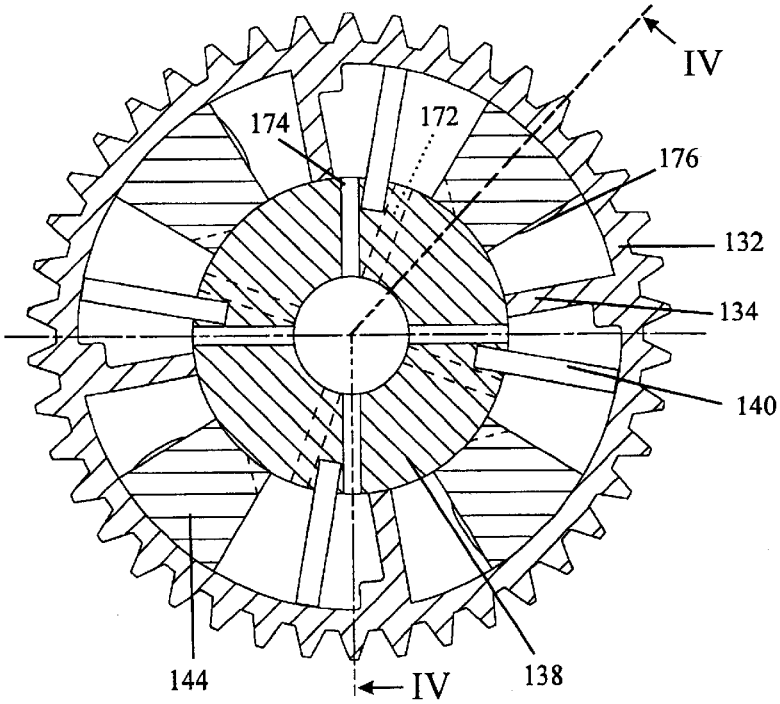
Fig. 5
Fig. 6
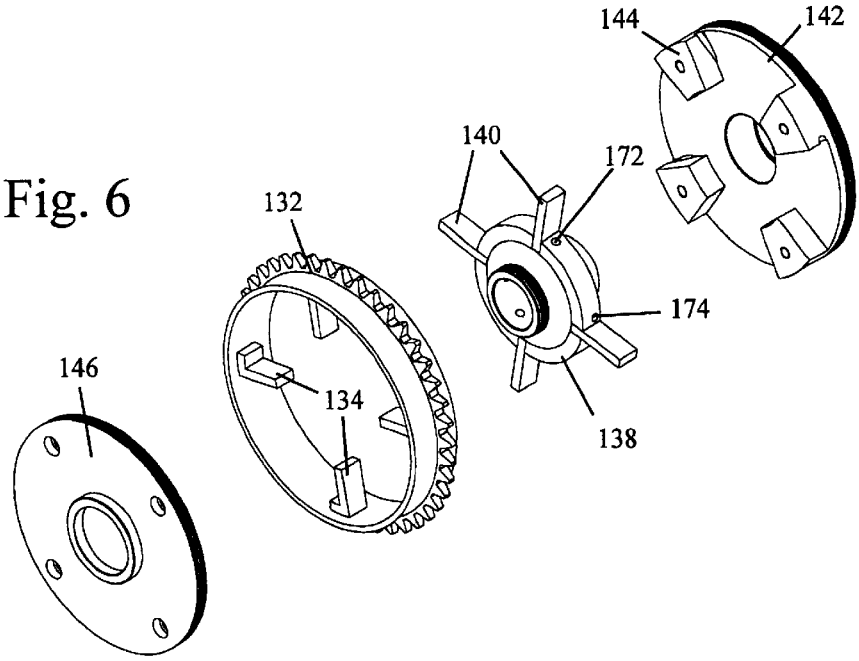

| Required Action / Control Port | Maintain Current Timing | Advance Driven Member 1 Only | Advance Driven Member 2 Only | Advance Both Driven Members | Advance Driven Member 1 and Retard Driven Member 2 | Advance Driven Member 2 and Retard Driven Member 1 |
|---|---|---|---|---|---|---|
| Port A | L | L | E | E | P | E |
| Port B | L | P | L | P | P | E |
| Port C | L | E | P | L | E | P |

L =Hydraulic Lock P = Hydraulic Pressure Applied E = Open to waste oil exhaust

VARIABLE PHASE DRIVE MECHANISM

The present invention relates to a variable phase drive mechanism for providing drive from an engine crankshaft to two sets of cams.

There have previously been proposed variable phase drive mechanisms that use hydraulic pressure to couple the drive and driven members to one another.

U.S. Pat. No. 5,002,023 uses a conventional pair of piston/cylinder units, or jacks, to couple a drive member (a sprocket) to a driven member (a camshaft). Because the connections of the jacks to the drive and driven members must allow relative pivoting, such a design is complex and bulky and makes it difficult to establish hydraulic connections with the working chambers of the jacks. In the case of an engine with two camshafts, this patent proposes mounting such a variable phase drive mechanism on the drive sprocket of each of the camshafts to allow their phases to be varied independently of one another relative to the engine crankshaft.

EP-0 924 393 and GB-2 319 071 use an alternative form of hydraulic coupling in which an annular space is provided between concentric drive and driven members. The space is divided into segment-shaped or arcuate variable volume working chambers by means of a first set of vanes extending radially inwards from the inner surface of the drive member and a second set of vanes that extend outwards from the outer surface of the driven member. As hydraulic fluid is admitted into and expelled from the various chambers, the vanes rotate relative to one another and thereby vary the relative angular position of the drive and driven members. Hydraulic couplings that use radial vanes to apply a tangentially acting force rather than a linear acting force will herein be referred to as vane-type couplings.

According to the present invention, there is provided a variable phase drive mechanism for providing drive from an engine crankshaft to two sets of cams, the drive mechanism comprising a drive member connectable for rotation with the engine crankshaft and two driven members each connectable for rotation with a respective one of the two sets of cams, wherein the drive and driven members are all mounted for rotation about a common axis and the driven members are coupled for rotation with the drive member by means of vane-type hydraulic couplings.

In prior art proposals, separate drive mechanism were needed to permit the phases of two camshafts to be varied independently of one another relative to the engine crankshaft. By providing two driven members that rotate about the same axis as the drive member, the invention permits a single drive mechanism to be used for both camshafts, thereby providing a significant cost saving.

The invention also offers a significant reduction in the size of the mechanism as the entire phase shifting mechanism can be accommodated within the space normally occupied by a conventional cam drive pulley or sprocket.

It is possible for the two sets of cams to be rotatable about the same axis as one another, the engine having a camshaft assembly in which the first set of cams is mounted on an outer tube and the second set of cams is fast in rotation with an inner shaft mounted concentrically within and rotatable relative to the outer tube.

Alternatively, the two sets of cams may be fixed cams on two separate camshafts each rotatable with a respective one of the driven members. In this case, one of the driven members may be directly connected to one of the camshafts while the other may be connected using a chain, a toothed belt or a gear train.

The hydraulic connection between the drive member and each of the driven members may comprise at least one arcuate cavity defined between the members and a radial vane projecting from one of the members into the arcuate cavity to divide the cavity into two variable volume working chambers, the pressure in which working chambers acts on the opposite sides of the radial vane.

As a further possibility, an arcuate cavity defined between the members may be divided into three working chambers by two radial vanes each fast in rotation with a respective one of the members. In this case, the pressures in the three working chambers may varied to set the desired angular position of each of the vanes within the cavity independently of the other.

Regardless of whether the arcuate cavities are divided into two or three working chambers, it is possible to arrange for all the cavities to intersect a common plane normal to the rotational axis of the members. This enables the mechanism to be very compact as it avoids the vane-type couplings having to be staggered along the axis of the mechanism.

Figure 2:
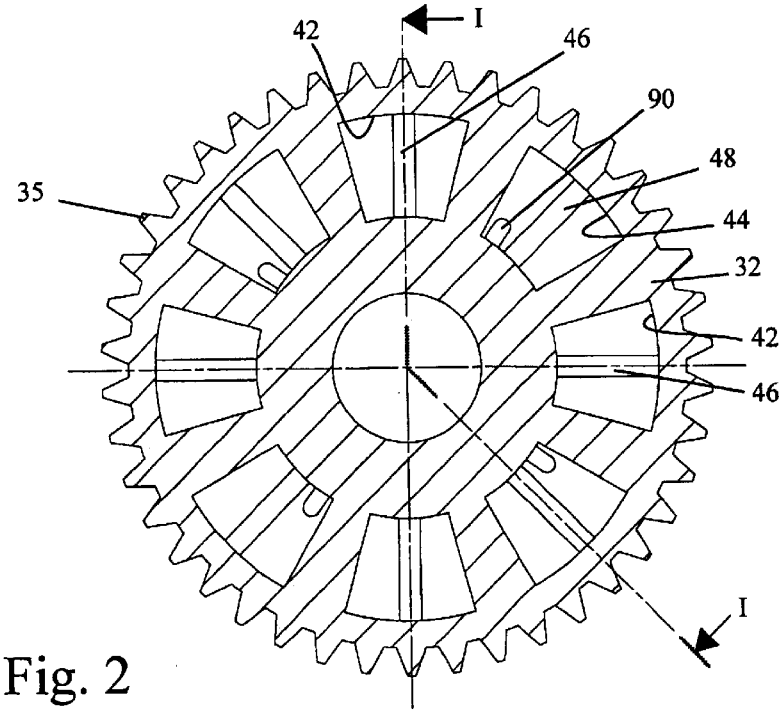
Figure 3:
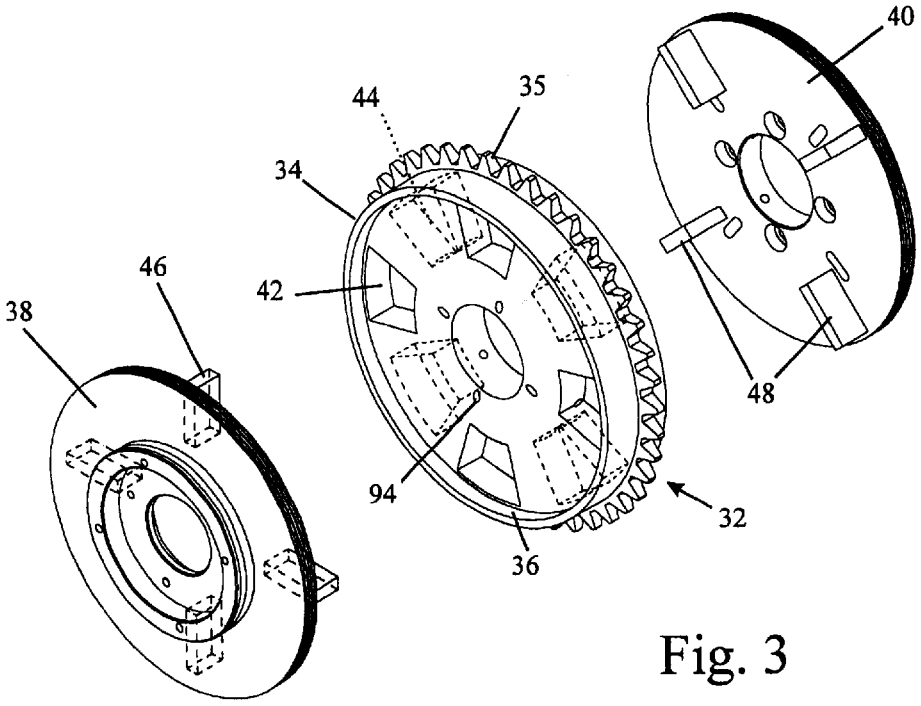
Figure 4:
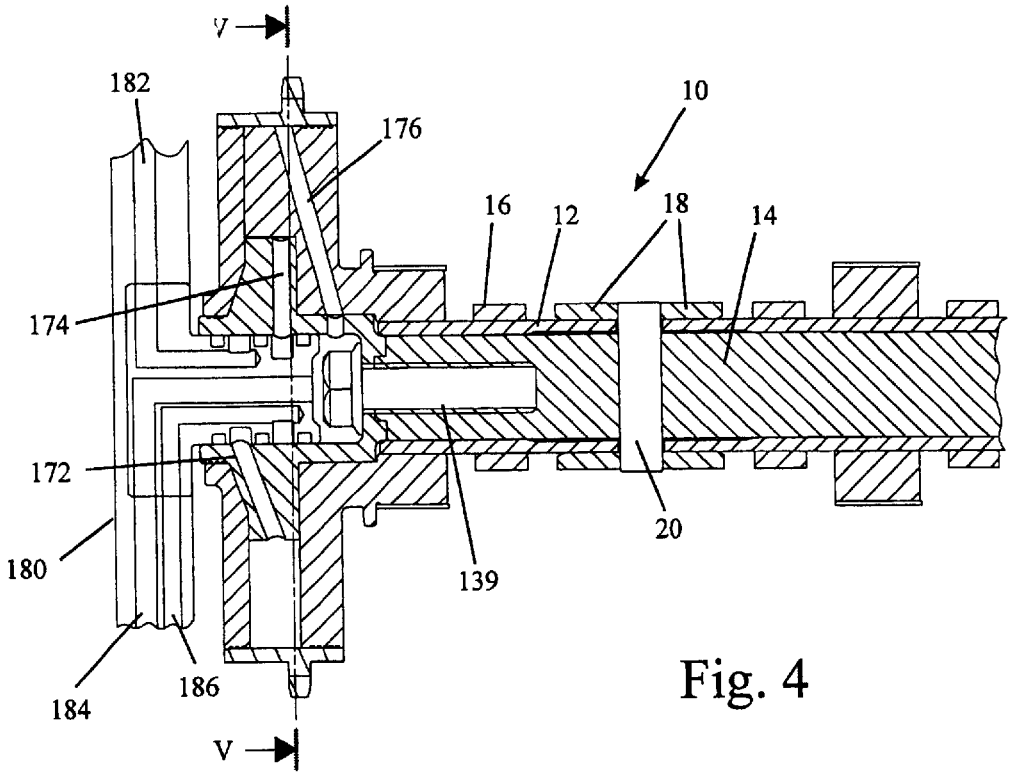
Figures 7, 8:
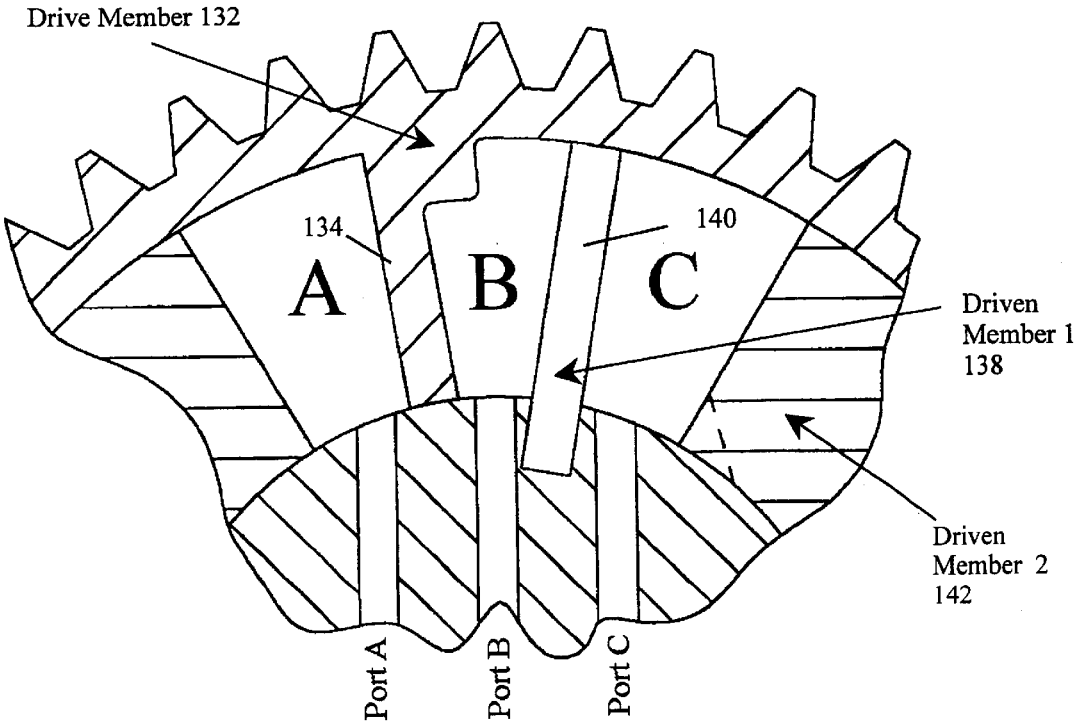
Figure 9:
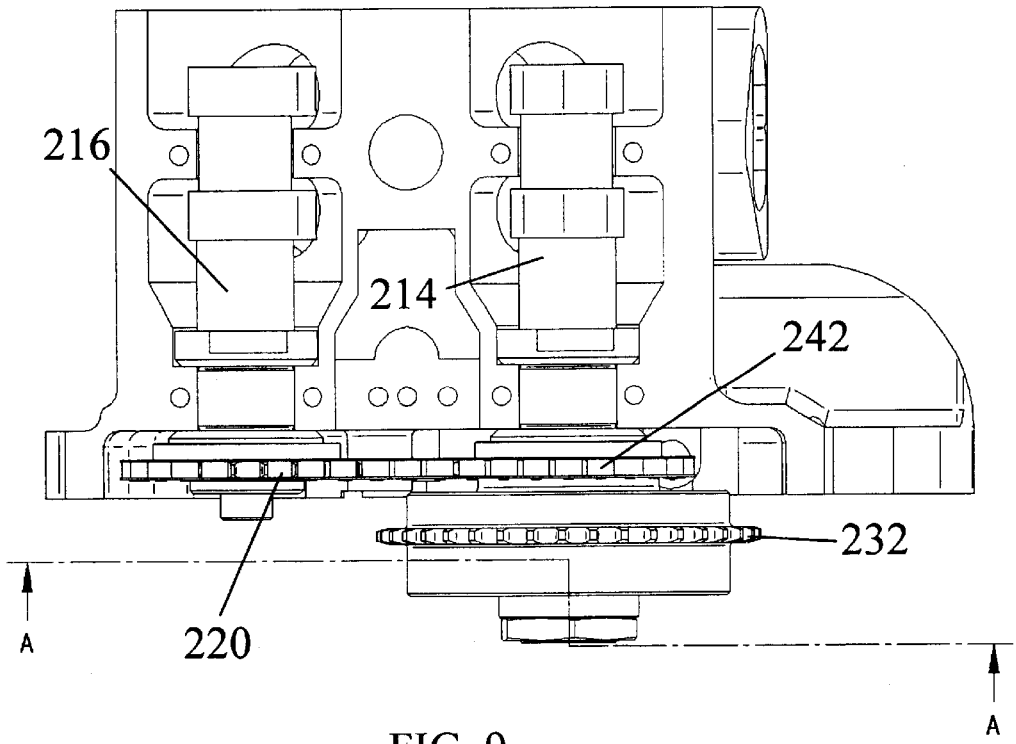
Figure 10:
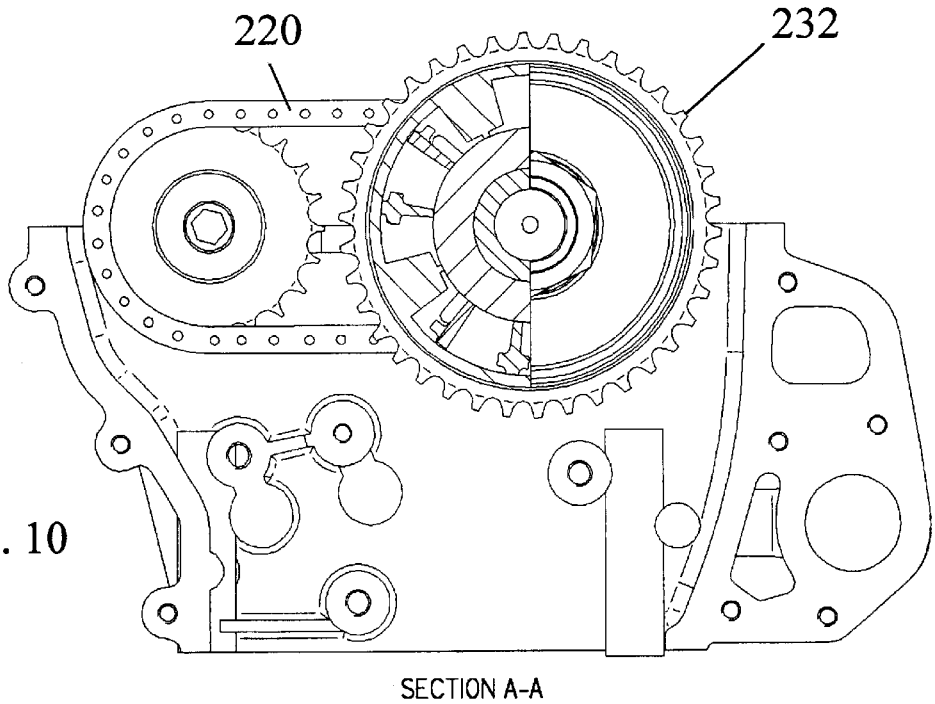

The invention will now be described further, by way of example, with reference to the accompanying drawings, in which:

FIG. 1 is a longitudinal section through a first embodiment of the invention, in the plane represented by the section line I—I in FIG. 2, FIG. 2 is a transverse section in the plane represented by the line II—II in FIG. 1, FIG. 3 is an exploded perspective view of the drive member and the two driven members of the mechanism shown in FIGS. 1 and 2, FIG. 4 is a longitudinal section through a second embodiment of the invention, in the plane represented by the section line IV—IV in FIG. 5, FIG. 5 is a transverse section in the plane represented by the line V—V in FIG. 4, FIG. 6 is an exploded perspective view of the drive member and the two driven members of the mechanism shown in FIGS. 4 and 5, FIG. 7 is a detail of the embodiment of FIG. 5 drawn to an enlarged scale and showing the positioning of the ports leading to the three working chambers, FIG. 8 is a table showing the pressures that must be applied to the three working chambers in FIG. 7 to achieve independent control of the phase of the two driven members, FIG. 9 is a plan view of a cylinder head that uses a variable phase drive mechanism os a further embodiment of the invention, and FIG. 10 shows the embodiment of FIG. 9 as seen in the partial sectional plane A—A-.

FIG. 1 shows a section through an assembled camshaft 10 with a variable phase drive mechanism of the invention incorporated into its drive sprocket 30. The camshaft assembly comprises an inner shaft 14 surrounded by an outer sleeve or tube 12 which can rotate relative to the shaft 14 through a limited angle. One set of cams 16 is directly connected to the outer tube 12. A second set of cams 18 is freely journalled on the outer tube 12 and is connected to the inner shaft 14 by pins which pass through tangentially elongated slots in the outer tube 12.

The end of the inner shaft 14 that projects at the front end of the engine carries the drive sprocket 30 which incorporates a variable phase drive mechanism of the invention which is best understood from the exploded view shown in FIG. 3. The coupling comprises a drive member 32 in the form of a thick disk 34 which is formed with sprocket teeth 35 and is driven by the engine crankshaft. Of course, the drive member 32 could equally be part of a chain sprocket or a toothed belt pulley.

The drive member 32 is formed on its opposite sides with shallow recesses 36 to receive two driven members 38 and 40. As will be seen in FIG. 1, the first driven member 38 is keyed in for rotation with the inner shaft 14 of the assembled camshaft while the second driven member 40 is connected to the outer tube 12 by bolts 60 that are screwed into the front camshaft support 62.

Additionally, the drive member 32 is formed on each side with further arcuate blind recesses 42 and 44 which are covered by the respective driven members 38 and 40 to form sealed hydraulic cavities. Each of the cavities is divided into two working chambers by radial vanes 46 and 48. Various ports, described in more detail below, are formed in the drive member 32 to establish a hydraulic connection to the two working chambers.

The hydraulic controls in this embodiment of the invention are completely separate from one another. The cavities 42 and vanes 46 form a first vane-type coupling that rotates the first driven member 38 in relation to the drive member 32, while the cavities 44 on the opposite side of the drive member 32 and the vanes 48 form a second vane-type coupling that adjusts the phase of the second driven member 40.

To supply oil to the different working chambers of the two sets of jacks, the engine front cover 70 is formed with a spigot 72 that is received in a bore at the front end of the inner shaft 14. Suitable rotary seals are provided between the stationary front cover 70 and the rotating drive and driven members. Hydraulic lines 80, 82, in the engine front cover, communicate with ports 90 and 92 respectively that are formed in the driven member 40 and the drive member 32 and that lead to the working chambers on the opposite sides of the vanes 48. Similarly, hydraulic lines 84 and 86 in the front cover 70 communicate with ports 94 and 96 respectively that are formed in the drive member 32 and the driven member 38, and that lead to the working chambers on the opposite sides of the vanes 46.

The major difference between the embodiment of FIGS. 4 to 8 and that previously described is the vanes of the hydraulic couplings associated with the two driven members move in a common arcuate cavity, and each cavity is divided into three rather than two working chambers. As will be explained below, such a configuration enables the number of hydraulic control lines to be reduced from four to three.

In describing the second embodiment of the invention, in order to avoid unnecessary repetition, components that are the same as those described in relation to the embodiment of FIGS. 1 to 3 have been allocated the same reference numerals and will not be described again.

As best shown in FIG. 6, the drive mechanism of the second embodiment of the invention comprises a drive member 132 in the form of an annular ring having teeth to enable it to be driven in synchronism with the engine crankshaft. Instead of being formed with cavities, the drive member 132 in this case is formed with radially inwardly extending vanes 134. The first driven member 138 has the form of a hub that is secured by means of a bolt 139 (see FIG. 4) for rotation with the inner shaft 14 of the assembled camshaft 10. A second set of vanes 140 projects radially from the central hub of the first driven member. The second driven member 142 is in the form of a disc that is formed integrally with (or it may be connected to) the camshaft end bearing 62 for rotation with the outer tube 12 of the assembled camshaft 10. The plate 142 has four arcuate projections 144 which serve, as will be described below, to define the cavities. A cover plate is secured to the projections 144 with the driven member 138 and the drive member 132 sandwiched axially between the driven member 142 and the cover plate 146.

When the components shown in the exploded view of FIG. 6 are assembled to one another and to the camshaft 10, they define between them four arcuate cavities. Each cavity has radial end surface defined by the side walls of two of the projections 144. The radially inner surface of each cavity is defined by the radially outer surface of the hub of the driven member 138 and the radially outer surface of each cavity is defined by the radially inner surface of the annular drive member 132. The axial end surfaces of the cavities are defined by the driven member 142 and the cover plate 146.

Each of the cavities is divided into three working chambers by two vanes, the first being one of the vanes 140 projecting outwards from the driven member 138 and the second being one of the vanes 134 projecting radially inwards from the drive member 132.

The driven member 138 is formed with ports 172, 174 that open into the cavities one on each side of each vane 140. The driven member 142 on the other hand is formed with angled drillings 176 that communicate with each cavity in the working chamber between the vane 134 connected to the drive member 132 and the adjacent projection 144 of the driven member 142.

As with the embodiment of FIG. 1 to 3, the engine has a front cover 180 that has a spigot projecting into and suitably sealed relative to the hub of the driven member 138. Three hydraulic lines 182, 184, 186 in the cover 180 communicate respectively with the ports 172, 174 and 176 that lead of the three working chambers of each cavity.

In FIG. 7, one of the four cavities is shown schematically as being connected to three ports A, B and C corresponding respectively to the ports 176, 174, 172 described above. The table of FIG. 8 shows the necessary connections to the ports A, B and C to achieve the desired independent control of the phase of the two driven members 138 and 142. Each of the lines 182, 184 and 186 is connected to a control valve which has three positions, termed L, P and E in the table of FIG. 8. In the first position, all the ports connected to the line are closed so that oil can neither enter not leave the associated working chambers. In the position designated P in FIG. 8, Pressure is applied to the associated working chambers and in the position designated E, the associated working chambers are connected to Exhaust, i.e. to a drain line leading back to the oil pump or a reservoir connected to the oil pump.

As can be seen from examination of FIG. 8, any one or both of the driven members 138 and 142 can be moved in either direction relative to the drive member 132 by suitable selection of the position of the control valves connected to then lines 182, 184, 186.

Thus taking each of the columns of the table in FIG. 8 separately starting from the left, one sees first that if all three of the working chambers marked A, B and C in FIG. 7 are isolated from the oil supply the current timing is maintained and there is no relative angular displacement between the drive member 132 and the two driven members.

In the second column of the table, Port A is locked so that the second driven member 142 cannot move relative to the drive member 132. Ports B and C can now be connected to pressure and exhaust respectively to advance the first drive member 138 (or the connections may be reversed to retard the first driven member 138 without affecting the phase of the second driven member 142.

The third column shows that by locking working chamber B, the phase of the first driven member 138 may be maintained constant while the pressures in the working chambers A and C can be set to advance (or retard) the phase of the second driven member 142.

To advance both driven members at the same time, port C is locked, thereby locking the phase of the driven members 138 and 142 relative to one another. Ports A and B can then be connected to the pressure supply and the return line to move the two driven members at the same time in the desired direction relative to the drive member.

Connecting ports A and B to high pressure P while port C is connected to exhaust has the effect of collapsing working chamber C and maximising the volume of working chambers A and B. This corresponds to advancing the first driven member 138 and retarding the second driven member 142 relative to the drive member 132. Conversely, connecting ports A and B to exhaust while pressurising chamber C has the effect or stacking the two vanes 134 and 140 at the left hand end of the cavity as shown in FIG. 7; this corresponding to advancing of the second driven members 142 and retarding the phase of the first driven member 138.

Both of the illustrated embodiments of the invention described above have been shown driving an assembled camshaft having two cam sets that can move relative to another as they both rotate about the same axis. In the embodiment of FIGS. 9 and 10, that instead of being connected to the outer tube of an assembled camshaft, one of the driven members 242 is a sprocket that is freely journalled about a solid camshaft and is coupled by a chain 220 for rotation with a second camshaft 214 on which are formed the second set of cams. The second camshaft 216 is arranged parallel to the first camshaft 214 which is concentric with the drive member 232. The internal construction of the variable phase drive mechanism is in other respects the same as that of the embodiment of FIG. 5 and need not therefore be described in greater detail.

It should also be appreciated that the two cam sets need not act on inlet and exhaust valves and it is alternatively possible, for example, to use the variable phase drive mechanism of the invention to drive cam sets acting on separate inlet valves or separate exhaust valves in any engine having multiple valves per cylinder. In this case, the phase variation can be used to alter the duration of an intake or exhaust event by effectively allowing its commencement time and its termination time to be adjusted independently of one another.

What is claimed is:

1. A variable phase drive mechanism for providing drive from an engine crankshaft to two sets of cams, the drive mechanism comprising a drive member connectable for rotation with the engine crankshaft and two driven members each connectable for rotation with a respective one of the two sets of cams, wherein the drive and driven members are all mounted for rotation about a common axis and the driven members are coupled for rotation with the drive member by means of vane-type hydraulic couplings to enable the phase of the driven members to be adjusted independently of one another relative to the drive member.

2. A mechanism as claimed in claim 1, wherein the hydraulic connection between the drive member and each of the driven members comprises at least one arcuate cavity defined between the members and a radial vane projecting from one of the members into the arcuate cavity to divide the cavity into two variable volume working chambers, the pressure in the working chambers acting on the opposite sides of the radial vane.

3. A mechanism as claimed in claim 2, wherein the arcuate cavities of the vane-type couplings acting between the drive member and both of the driven members intersect a common plane normal to the rotational axis of the members.

4. A mechanism as claimed in claim 1, wherein an arcuate cavity defined between the members is divided into three working chambers by two radial vanes each fast in rotation with a respective one of the members.

5. A mechanism as claimed in claim 4, wherein the arcuate cavities of the vane-type couplings acting between the drive member and both of the driven members intersect a common plane normal to the rotational axis of the members.

6. An engine valve train comprising a mechanism as claimed in claim 1 in combination with two sets of cams, wherein the two sets of cams are rotatable about the same axis as one another, a first set of cams being mounted on an outer tube and the second set of cams being fast in rotation with an inner shaft mounted concentrically within and rotatable relative to the outer tube.

7. An engine valve train as claimed in claim 6, wherein one of the driven members is directly connected to one of the camshafts and the second driven member is coupled to the second camshaft by means of a chain.

8. An engine valve train comprising a mechanism as claimed in claim 1, in combination with two sets of cams, wherein the two sets of cams are formed by fixed cams on two separate camshafts, each camshaft being rotatable with a respective one of the driven members.

* * * * *